US007874112B2

(12) United States Patent
Kovatch et al.

(10) Patent No.: US 7,874,112 B2
(45) Date of Patent: Jan. 25, 2011

(54) FOOTER CLEAT FOR INSULATING CONCRETE FORM

(75) Inventors: Frank Kovatch, Pittsburgh, PA (US); Les Molke, Copley, OH (US); Jeffrey Beaman, Monaca, PA (US); Justin Rubb, Coraopolis, PA (US)

(73) Assignee: NOVA Chemicals Inc., Moon Township, PA (US)

( * ) Notice: Subject to any disclaimer, the term of this patent is extended or adjusted under 35 U.S.C. 154(b) by 0 days.

(21) Appl. No.: 12/479,910

(22) Filed: Jun. 8, 2009

(65) Prior Publication Data

US 2009/0313914 A1 Dec. 24, 2009

Related U.S. Application Data

(60) Provisional application No. 61/074,175, filed on Jun. 20, 2008.

(51) Int. Cl.
*E04C 1/00* (2006.01)

(52) U.S. Cl. ..... 52/309.1; 52/414; 52/421; 52/699

(58) Field of Classification Search ..... 52/309.1, 52/414, 421, 699; 249/34
See application file for complete search history.

(56) References Cited

U.S. PATENT DOCUMENTS

| | | | | |
|---|---|---|---|---|
| 2,518,186 | A | | 8/1950 | Rumble |
| 2,983,692 | A | | 5/1961 | D'Alelio |
| 3,021,291 | A | | 2/1962 | Thiessen |
| 3,023,175 | A | | 2/1962 | Rodman, Jr. |
| 3,214,393 | A | | 10/1965 | Sefton |
| 3,257,338 | A | | 6/1966 | Sefton |
| 3,272,765 | A | | 9/1966 | Sefton |
| 3,778,020 | A | | 12/1973 | Burrows et al. |
| 4,026,723 | A | | 5/1977 | Grof et al. |
| 4,257,571 | A | * | 3/1981 | Franks ..... 249/207 |
| 4,298,394 | A | | 11/1981 | Leeming et al. |
| 4,303,756 | A | | 12/1981 | Kajimura et al. |
| 4,303,757 | A | | 12/1981 | Kajimura et al. |
| 4,574,550 | A | | 3/1986 | Maschhoff |
| 4,884,382 | A | | 12/1989 | Horobin |
| 4,889,310 | A | | 12/1989 | Boeshart |

(Continued)

FOREIGN PATENT DOCUMENTS

| | | |
|---|---|---|
| JP | 9071449 | 3/1997 |

(Continued)

*Primary Examiner*—Richard E Chilcot, Jr.
*Assistant Examiner*—Mark R Wendell
(74) *Attorney, Agent, or Firm*—Gary F. Matz

(57) ABSTRACT

Methods of constructing concrete walls that include placing a plurality of cleats along a wall perimeter, securing the cleats to a surface under the wall perimeter, placing a plurality of insulating concrete forms along the perimeter, and placing concrete into the insulating concrete forms to form the insulating concrete wall. The cleats include a base plate, a first vertical flange extending approximately perpendicular from the base plate, and a second vertical flange extending approximately parallel to the first vertical flange. The space defined by the first vertical flange, second vertical flange and the base plate, is adapted to receive a bottom portion of a form component or a bottom portion of a form. The insulating concrete forms are placed along the perimeter such that a bottom portion of the form components or a bottom portion of the form are press fit into the defined space.

20 Claims, 7 Drawing Sheets

U.S. PATENT DOCUMENTS 5,211,751 A 5/1993 Arfaei et al.
5,234,654 A * 8/1993 Brooks ..... 264/219
5,333,429 A 8/1994 Cretti
5,390,459 A 2/1995 Mensen
RE35,194 E 4/1996 Gerber
5,566,518 A 10/1996 Martin et al.
5,568,710 A 10/1996 Smith et al.
5,580,378 A 12/1996 Shulman
5,622,556 A 4/1997 Shulman
5,657,600 A 8/1997 Mensen
5,701,710 A 12/1997 Tremelling
5,709,060 A 1/1998 Vaughan et al.
5,725,652 A 3/1998 Shulman
5,787,665 A 8/1998 Carlin et al.
5,809,728 A 9/1998 Tremelling
5,822,940 A 10/1998 Carlin et al.
5,845,449 A 12/1998 Vaughan et al.
5,887,401 A 3/1999 Moore, Jr.
5,890,337 A 4/1999 Boeshart
6,098,367 A 8/2000 Fridman et al.
6,127,439 A 10/2000 Berghmans et al.
6,160,027 A 12/2000 Crevecoeur et al.
6,167,624 B1 1/2001 Lanahan et al.
6,170,220 B1 1/2001 Moore, Jr.
6,230,451 B1 5/2001 Stoller
6,235,367 B1 5/2001 Holmes et al.
6,242,540 B1 6/2001 Crevecoeur et al.
6,314,697 B1 11/2001 Moore, Jr.
6,318,040 B1 11/2001 Moore, Jr.
6,336,301 B1 1/2002 Moore, Jr.
6,363,683 B1 4/2002 Moore, Jr.
6,378,260 B1 4/2002 Williamson et al.
6,438,918 B2 8/2002 Moore, Jr. et al.
6,526,713 B2 3/2003 Moore, Jr.
6,588,168 B2 7/2003 Walters
6,647,686 B2 11/2003 Dunn et al.
6,702,247 B2 * 3/2004 Takagi ..... 249/189
6,820,384 B1 11/2004 Pfeiffer
6,851,235 B2 2/2005 Baldwin
6,931,798 B1 * 8/2005 Pocai ..... 52/102
7,032,357 B2 4/2006 Cooper et al.
7,444,789 B1 * 11/2008 Moore ..... 52/426
2002/0116889 A1 8/2002 Moore, Jr.
2002/0117769 A1 8/2002 Arch et al.
2003/0005659 A1 1/2003 Moore, Jr.
2004/0152795 A1 8/2004 Arch et al.
2006/0251851 A1 11/2006 Bowman
2007/0125275 A1 6/2007 Bui
2008/0066408 A1 3/2008 Hileman et al.
2008/0104911 A1 5/2008 Jarvie et al.
2008/0104912 A1 5/2008 Au et al.
2008/0107852 A1 5/2008 Rubb et al.
2008/0250739 A1 10/2008 Krupinski et al.

FOREIGN PATENT DOCUMENTS

WO 98/02397 A1 1/1998
WO 00/61519 A1 10/2000
WO 01/66485 A2 9/2001
WO 2008/033654 A2 3/2008

* cited by examiner

183

FOOTER CLEAT FOR INSULATING CONCRETE FORM

REFERENCE TO RELATED APPLICATION

This application claims the benefit of priority of U.S. Provisional Application Ser. No. 61/074,175 filed Jun. 20, 2008, entitled "Footer Cleat for Insulating Concrete Form" which is incorporated by reference in its entirety.

BACKGROUND OF THE INVENTION

1. Field of the Invention

The present invention is directed to articles and methods for constructing a concrete structure using insulating concrete forms.

2. Description of the Prior Art

Techniques have developed in the building construction arts for forming modular concrete walls, which use a foam insulating material. The modular form walls are set up parallel to each other and connecting components hold the two form walls in place relative to each other while concrete is poured there between. The form walls remain in place after the concrete cures. That is, the form walls, which are constructed of foam insulating material and generally referred to as insulating concrete forms (ICF), are a permanent part of the building after the concrete cures. The concrete walls made using this technique can be stacked on top of each other many stories high to form all of a building's walls. In addition to the efficiency gained by retaining the form walls as part of the permanent structure, the materials of the form walls often provide adequate insulation for the building.

Insulated concrete forms (ICF) made all or in part from molded foamed thermoplastics are known in the art, as disclosed for example in U.S. Pat. Nos. 5,333,429; 5,390,459; 5,566,518; 5,568,710; 5,657,600; 5,709,060; 5,787,665; 5,822,940; 5,845,449; 5,887,401; 6,098,367; 6,167,624; 6,170,220; 6,235,367; 6,314,697; 6,318,040; 6,336,301; 6,363,683; 6,438,918; 6,526,713; 6,588,168; 6,647,686 and 6,820,384; in U.S. Patent Application Publication Nos. 2002/0116889; 2003/0005659; 2006/0251851; 2008/0066408; 2008/0104911; 2008/0104912; 2008/0107852 and 2008/0250739.

However, in many cases the ICF's tend to spread and/or uplift when concrete is poured into the form. These problems can ultimately result in the form failing and concrete escaping from the form, commonly referred to as "blow out".

Thus, there is a need in the art for articles and methods that can adequately hold an ICF in place and prevent spread, uplift, and/or blow out of the form.

SUMMARY OF THE INVENTION

The present invention provides methods of constructing insulating concrete walls that include placing a plurality of cleats along a wall perimeter, securing the cleats to a surface under the wall perimeter, placing a plurality of insulating concrete forms along the perimeter, and placing concrete into the insulating concrete forms to form the insulating concrete wall.

The cleats according to the invention include a base plate, a first vertical flange extending approximately perpendicular from the base plate, and a second vertical flange extending approximately perpendicular from the base plate and approximately parallel to the first vertical flange. The space defined by the first vertical flange, second vertical flange and the base plate, is adapted to receive a bottom portion of a form component or a bottom portion of a form.

The plurality of insulating concrete forms are placed along the perimeter such that a bottom portion of the form components or a bottom portion of the form are press fit into the space defined by the first vertical flange, second vertical flange and the base plate.

DETAILED DESCRIPTION OF THE INVENTION

Figure 1:
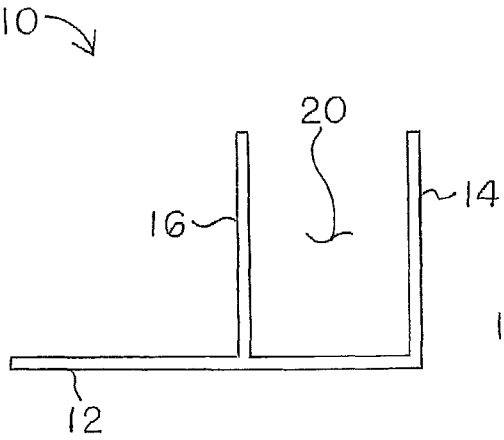
FIG. 1 shows a front elevation view of a cleat embodiment according to the invention.
Figure 2:
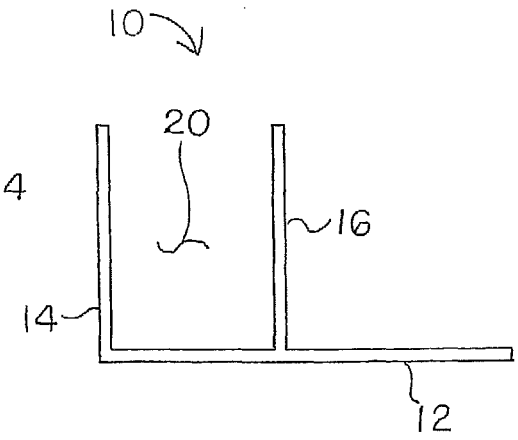
FIG. 2 shows a rear elevation view of a cleat embodiment according to the invention.
Figure 3:
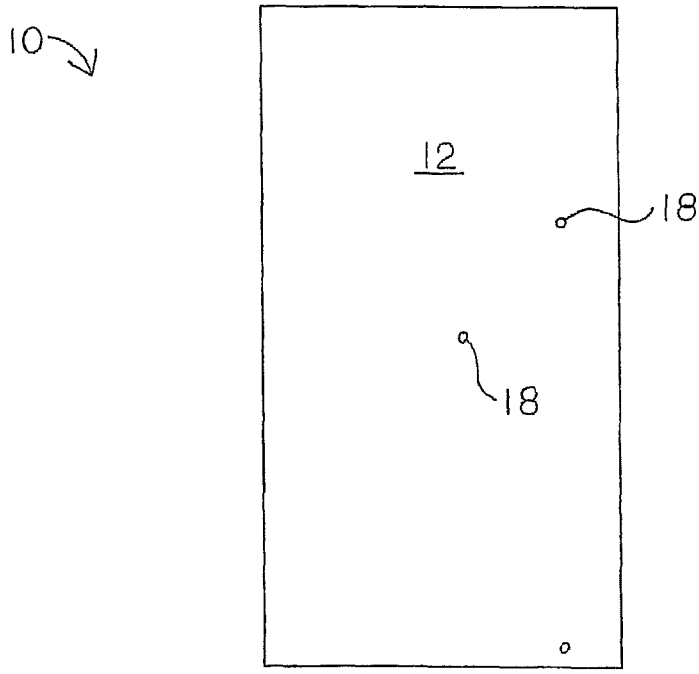
FIG. 3 shows a bottom plan view of a cleat embodiment according to the invention.
Figure 4:
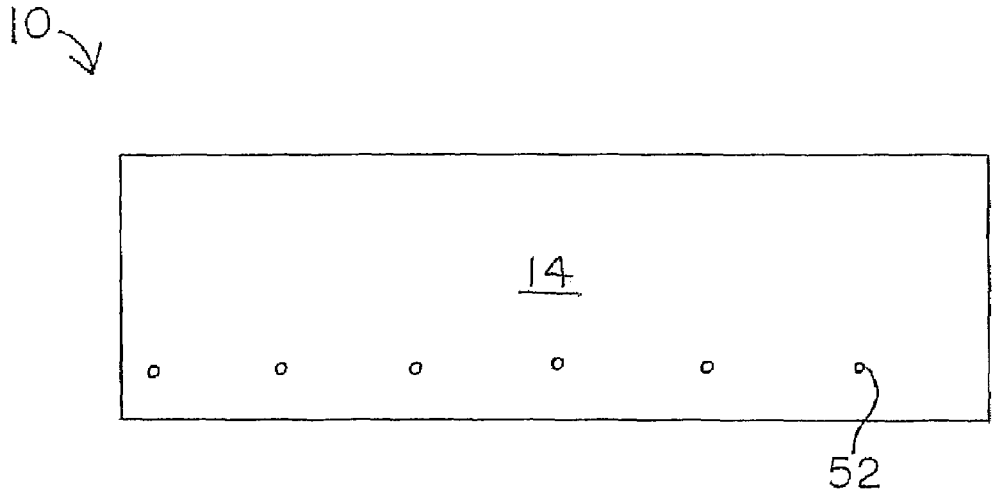
FIG. 4 shows a side elevation view of a cleat embodiment according to the invention.
Figure 5:
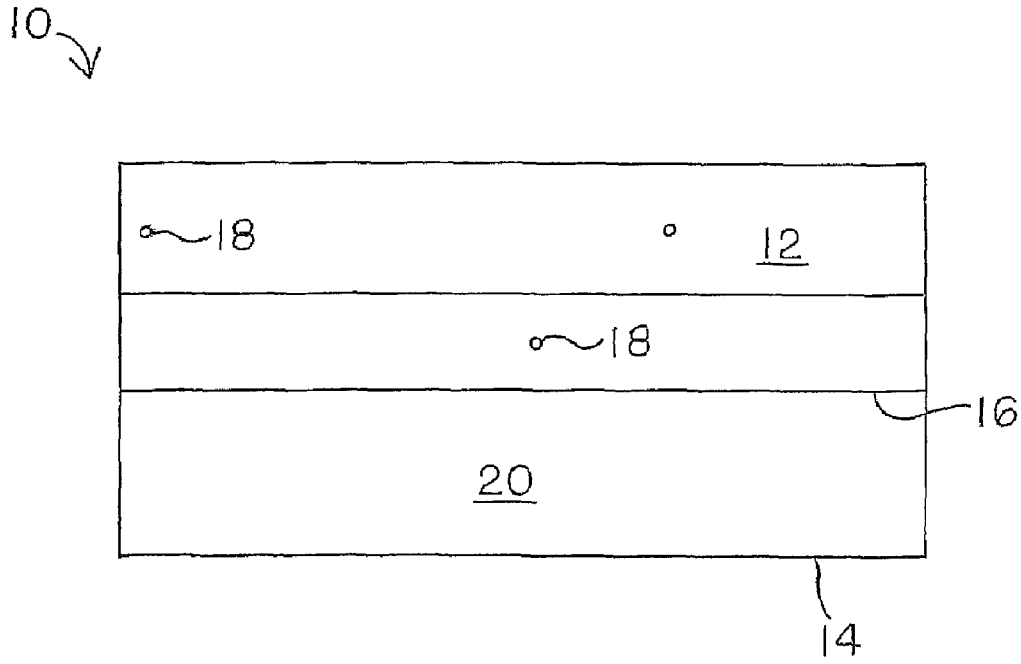
FIG. 5 shows a top plan view of a cleat embodiment according to the invention.
Figure 6:
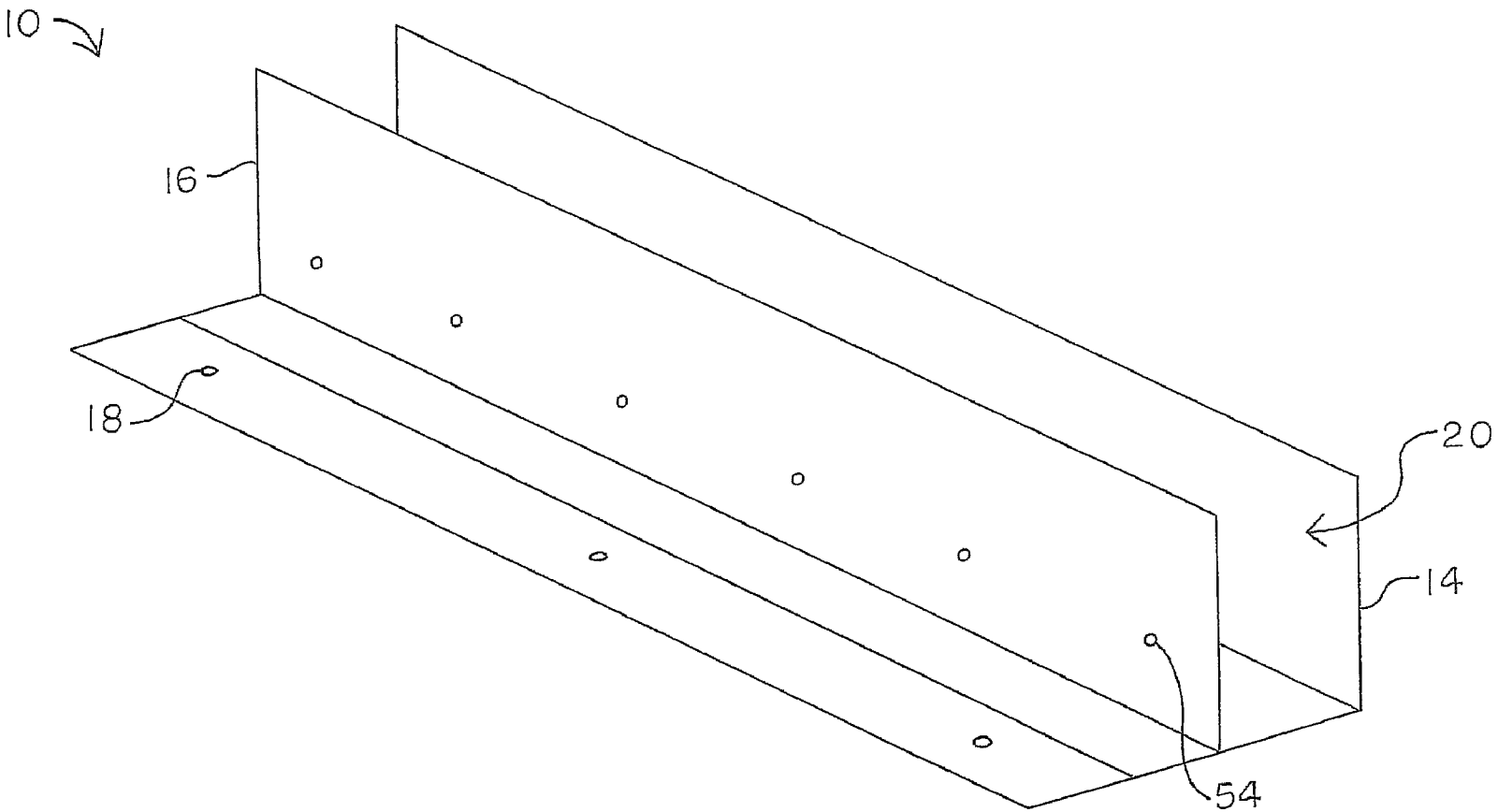
FIG. 6 shows a perspective view of a cleat embodiment according to the invention.
Figure 7:
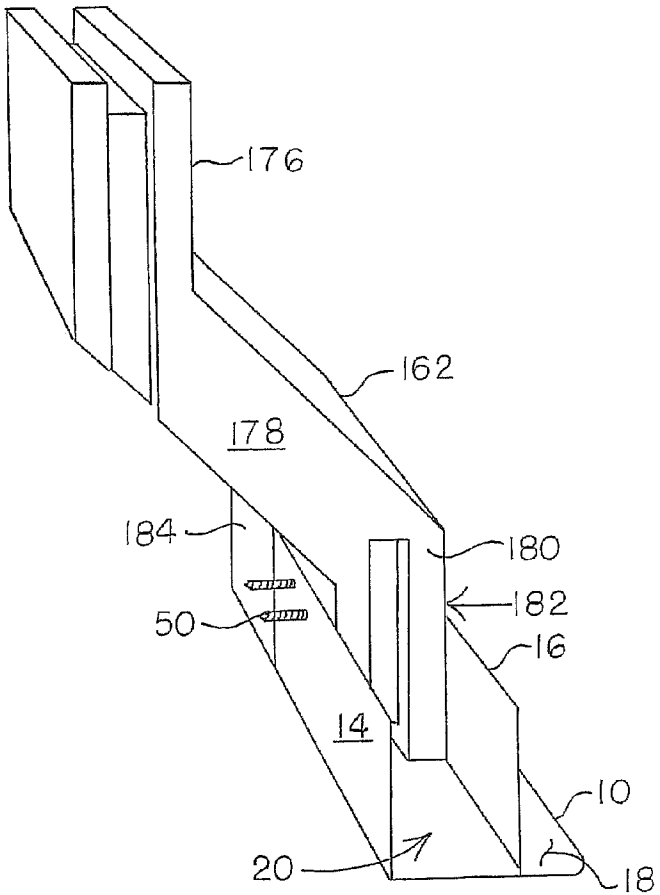
FIG. 7 shows a front perspective view of a footer portion of an insulating concrete form using a cleat embodiment according to the invention.
Figure 7:
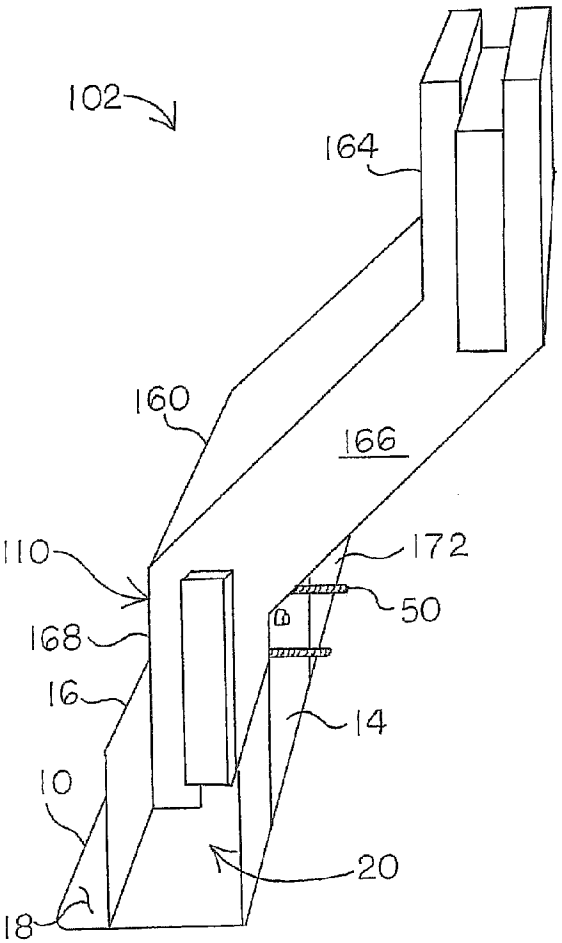
Figure 9:
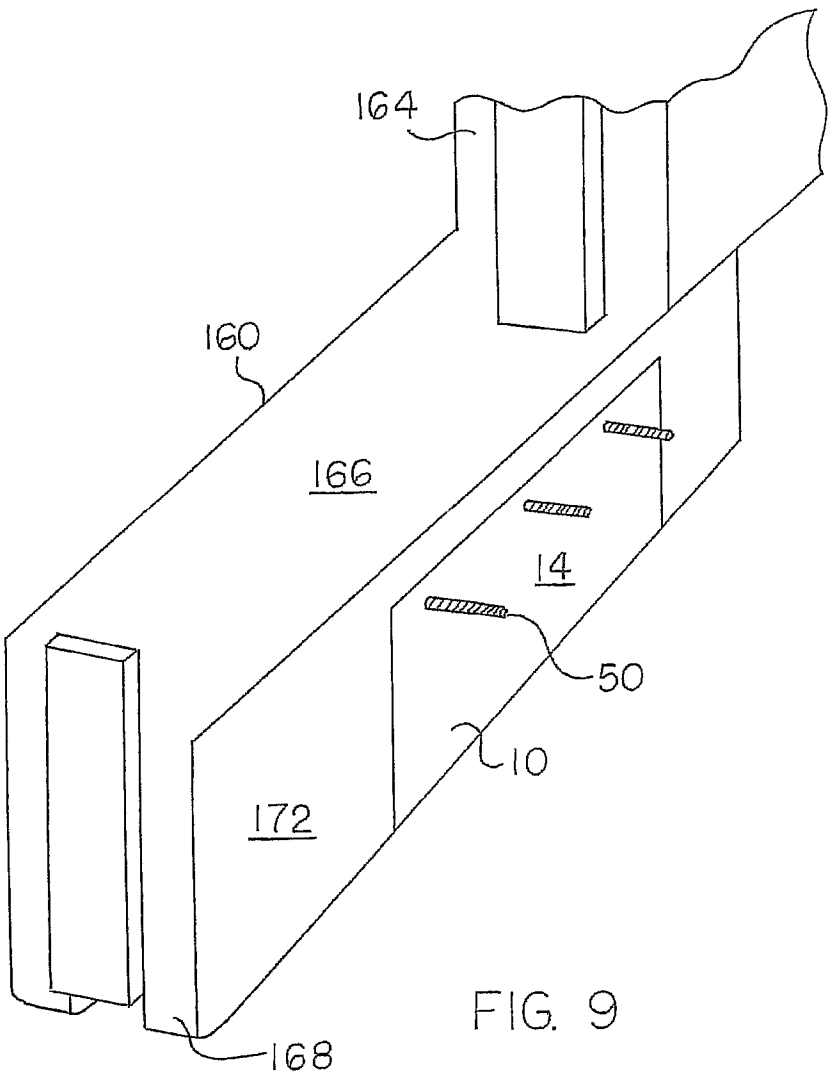
FIG. 9 shows a partial perspective view of a footer portion of an insulating concrete form using a cleat embodiment according to the invention.
Figure 8:
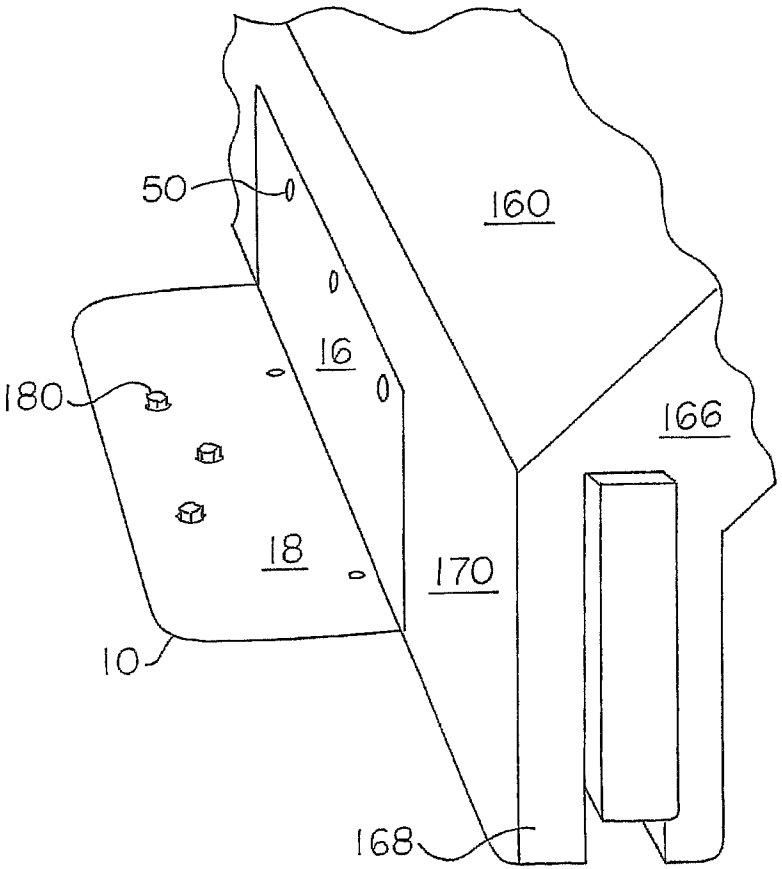
FIG. 8 shows a partial perspective view of a footer portion of an insulating concrete form using a cleat embodiment according to the invention.

For the purpose of the description hereinafter, the terms "upper", "lower", "inner", "outer", "right", "left", "vertical", "horizontal", "top", "bottom" and derivatives thereof, shall relate to the invention as oriented in the drawing figures. However, it is to be understood that the invention may assume alternate variations and step sequences except where expressly specified to the contrary. It is also to be understood that the specific devices and processes, illustrated in the attached drawings and described in the following specification, is an exemplary embodiment of the present invention. Hence, specific dimensions and other physical characteristics related to the embodiment disclosed herein are not to be considered as limiting the invention. In describing the embodiments of the present invention, reference will be made herein to the drawings in which like numerals refer to like features of the invention.

Other than where otherwise indicated, all numbers or expressions referring to quantities, distances, or measurements, etc. used in the specification and claims are to be understood as modified in all instances by the term "about". Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective measurement methods.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

As used herein, the term "press fit" refers to a fastening between two parts which is achieved by friction after the parts are pushed together.

As used herein, the term "expandable polymer matrix" refers to a polymeric material in particulate or bead form that is impregnated with a blowing agent such that when the particulates and/or beads are placed in a mold and heat is applied thereto, evaporation of the blowing agent (as described below) effects the formation of a cellular structure and/or an expanding cellular structure in the particulates and/or beads and the outer surfaces of the particulates and/or beads fuse together to form a continuous mass of polymeric material conforming to the shape of the mold.

As used herein, the term "polymer" is meant to encompass, without limitation, homopolymers, copolymers and graft copolymers.

As used herein, the terms "(meth)acrylic" and "(meth) acrylate" are meant to include both acrylic and methacrylic acid derivatives, such as the corresponding alkyl esters often referred to as acrylates and (meth)acrylates, which the term "(meth)acrylate" is meant to encompass.

As used herein, the term "component" refers to a part used to construct an insulating concrete form, a non-limiting example of which includes panel members as described herein, or a one-piece insulating concrete form as described herein.

The present invention provides methods of constructing an insulating concrete wall. The methods include placing a plurality of cleats along a wall perimeter, securing the cleats to a surface under the wall perimeter; placing a plurality of insulating concrete forms in the cleats along the perimeter, and placing concrete into the insulating concrete forms.

As shown in FIGS. 1-6, cleat 10 includes base plate 12, first vertical flange 14, extending approximately perpendicular from base plate 12, and second vertical flange 16 extending approximately perpendicular from base plate 12 and approximately parallel to first vertical flange 14.

Cleat 10 can include anchor holes 18, which can be used to secure cleat 10 to a surface under the wall perimeter. Cleat 10 can be secured to the surface using anchor holes 18 by placing an appropriate anchor through holes 18 and into the surface. Any suitable anchor can be employed depending on the nature of the surface. Non-limiting examples of suitable anchors include spikes, nails, screws (which can be used in conjunction with appropriate anchoring fixtures embedded in the surface), rivets, staples and combinations thereof.

ICF space 20 is defined by first vertical flange 14, second vertical flange 16 and base plate 12, and is adapted to receive a bottom portion of an insulating concrete form component or a bottom portion of an insulating concrete form as described in more detail below.

In embodiments of the invention, cleat 10 can be made of a material selected from metal, construction grade plastics, composite materials, ceramics, and combinations thereof and the like.

Suitable plastics include homopolymers and copolymers of styrene, homopolymers and copolymers of $C_2$ to $C_{20}$ olefins, $C_4$ to $C_{20}$ dienes, polyesters, polyamides, homopolymers and copolymers of $C_2$ to $C_{20}$ (meth)acrylate esters, polyetherimides, polycarbonates, polyphenylethers, polyvinylchlorides, polyurethanes, and combinations thereof.

Suitable construction grade plastics include, but are not limited to reinforced thermoplastics, thermoset resins, and reinforced thermoset resins. Suitable thermoplastics include polymers and polymer foams made up of materials that can be repeatedly softened by heating and hardened again on cooling. Suitable thermoplastic polymers include, but are not limited to homopolymers and copolymers of styrene, homopolymers and copolymers of $C_2$ to $C_{20}$ olefins, $C_4$ to $C_{20}$ dienes, polyesters, polyamides, homopolymers and copolymers of $C_2$ to $C_{20}$ (meth)acrylate esters, polyetherimides, polycarbonates, polyphenylethers, polyvinylchlorides, polyurethanes, and combinations thereof.

Suitable thermoset resins are resins that when heated to their cure point, undergo a chemical cross-linking reaction causing them to solidify and hold their shape rigidly, even at elevated temperatures. Suitable thermoset resins include, but are not limited to alkyd resins, epoxy resins, diallyl phthalate resins, melamine resins, phenolic resins, polyester resins, urethane resins, and urea, which can be crosslinked by reaction, as non-limiting examples, with diols, triols, polyols, and/or formaldehyde.

Reinforcing materials and/or fillers that can be incorporated into the thermoplastics and/or thermoset resins include, but are not limited to carbon fibers, aramid fibers, glass fibers, metal fibers, woven fabric or structures of the mentioned fibers, fiberglass, carbon black, graphite, clays, calcium carbonate, titanium dioxide, woven fabric or structures of the above-referenced fibers, and combinations thereof.

A non-limiting example of construction grade plastics are thermosetting polyester or vinyl ester resin systems reinforced with fiberglass that meet the requirements of required test methods known in the art, non-limiting examples being ASTM D790, ASTM D695, ASTM D3039 and ASTM D638.

The thermoplastics and thermoset resins can optionally include other additives, as a non-limiting example, ultraviolet (UV) stabilizers, heat stabilizers, flame retardants, structural enhancements, biocides, and combinations thereof.

Suitable metals include, but are not limited to, aluminum, steel, stainless steel, tungsten, molybdenum, iron and alloys and combinations of such metals. In a particular embodiment of the invention, the metal bars, studs, joists and/or members are made of a light gauge metal.

Various insulating concrete forms can be used in the structures and methods of the present invention. As non-limiting examples, the insulating concrete forms disclosed in U.S. Pat. Nos. 5,333,429; 5,390,459; 5,566,518; 5,568,710; 5,657,600; 5,709,060; 5,787,665; 5,822,940; 5,845,449; 5,887,401; 6,098,367; 6,167,624; 6,170,220; 6,235,367; 6,314,697; 6,318,040; 6,336,301; 6,363,683; 6,438,918; 6,526,713; 6,588,168; 6,647,686 and 6,820,384; U.S. Patent Application Publication Nos. 2002/0116889; 2003/0005659; 2007/0201035; 2008/0066408; 2008/0104911; 2008/0104912; and 2008/0107852; the relevant portions of which are incorporated herein by reference. Commercially available insulating concrete forms that can be used include, but are not limited to those available under the tradenames GREENBLOCK® available from Greenblock Worldwide Corp, Stuart, Fla.; ECO-Block® available from ECO-Block, LLC, Dallas, Tex.; and QUAD-LOCK® available from Quad-Lock Building Systems Ltd., Surrey, BC, Canada.

In embodiments of the invention, the insulating concrete form includes a first panel member, a second panel member, and at least two connecting members. The first panel member includes (1) a first outer panel side including a first wall surface area extending generally vertically thereon; (2) a first inner panel side positioned oppositely from the first outer panel side; and (3) at least two first slots in the first inner panel side adapted to accept a connecting member. The second panel member includes (1) a second outer panel side including a second wall surface area extending generally vertically thereon and facing oppositely from the first panel member; (2) a second inner panel side positioned oppositely from the second outer panel side and facing the first inner panel side of the first panel member; and (3) at least two second slots in the second inner panel side adapted to accept a connecting member. The connecting members are detachable and securable with respect to the first panel member and the second panel member and are adapted to maintain a spatial distance therebetween for defining a molding chamber therebetween. The connecting members include (1) a first flange detachably and securably extending within the first slot of the first panel member; (2) a second flange detachably and securably extending within the second slot of the second panel member; and (3) a mid-section portion.

In many embodiments of the invention, the first panel member is press fit into one or more first cleats such that the first vertical flange contacts the first outer panel side and the second vertical flange contacts the first inner panel side; and the second panel member is press fit into one or more second cleats such that the first vertical flange contacts the second outer panel side and the second vertical flange contacts the second inner panel side.

In particular embodiments of the invention, the insulating concrete forms can be those available under the SAFE Block® trade name from SYNTHEON Inc., Pittsburgh, Pa. A non-limiting example of this embodiment is shown in FIGS. 7-10. In this exemplary embodiment, insulating concrete form assembly 100 includes footer section 102 and wall section 104, all held together by connecting members 106.

Wall section 104 includes first panel member 108 having first outer panel side 110 including a first wall surface area extending generally vertically thereon; first inner panel side 112 positioned oppositely from first outer panel side 110; and at least two first slots 114 in first inner panel side 112 adapted to accept connecting members 106; second panel member 116 includes second outer panel side 118 including a second wall surface area extending generally vertically thereon and facing oppositely from first panel member 108, second inner panel side 120 positioned oppositely from second outer panel side 118 and facing first inner panel side 112 of first panel member 108; and at least two second slots 122 in second inner panel side 120 adapted to accept connecting member 106. At least two connecting members 106 detachable and securable with respect to first panel member 108 and second panel member 116 adapted to maintain a spatial distance therebetween for defining molding chamber 124 therebetween.

A variety of connecting members are known in the art and the panels used in the present exemplary embodiment can be adapted to use them. Non-limiting examples of such connecting members are disclosed in U.S. Pat. Nos. 7,032,357; 6,378,260; 5,809,728; 5,890,337; 5,701,710; 4,889,310; and 4,884,382; the relevant portions of which are incorporated herein by reference.

In embodiments of the invention, connecting members 106 and connectors can be made of plastics, metal, construction grade plastics, composite materials, ceramics, and the like as described above regarding cleat 10.

Footer section 102 includes first footer panel 160, second footer panel 162 and two or more connecting members 106. First footer panel 160 includes upper leg 164, mid leg section 166, lower leg 168, first footer outer side 170, first inner footer side 172 positioned oppositely from outer side 170, and at least two first footer slots (not shown) adapted to accept connecting member 106. Second footer panel 162 includes upper leg 176, mid leg section 178, lower leg 180, second footer outer side 182, second inner footer side 184 positioned oppositely from outer side 182, and at least two second footer slots (not shown) adapted to accept connecting member 106.

Connecting members 106 are adapted to be detachably and securably extending within the first slot of first footer panel 160 and within the second slot of second footer panel 162. Mid-section portion 130 is adapted to span the distance between first inner side 172 and second inner side 184. At least two connecting members 106 detachable and securable with respect to first footer panel 160 and second footer panel 162 adapted to maintain a spatial distance therebetween for defining molding chamber 183 therebetween.

Wall section 104 is generally adapted to be placed on top of footer section 102, for example, inserting a raised tongue of wall section 104 into a groove portion of footer section 102. Adjacent sections are generally adapted to be joined together by, for example, inserting a tongue portion extending from a first edge of footer section 102 into a slot portion of a second edge of an adjacent footer section 102.

When used according to the present invention, rebar is typically placed in chambers 124 and 183.

Figure 10:
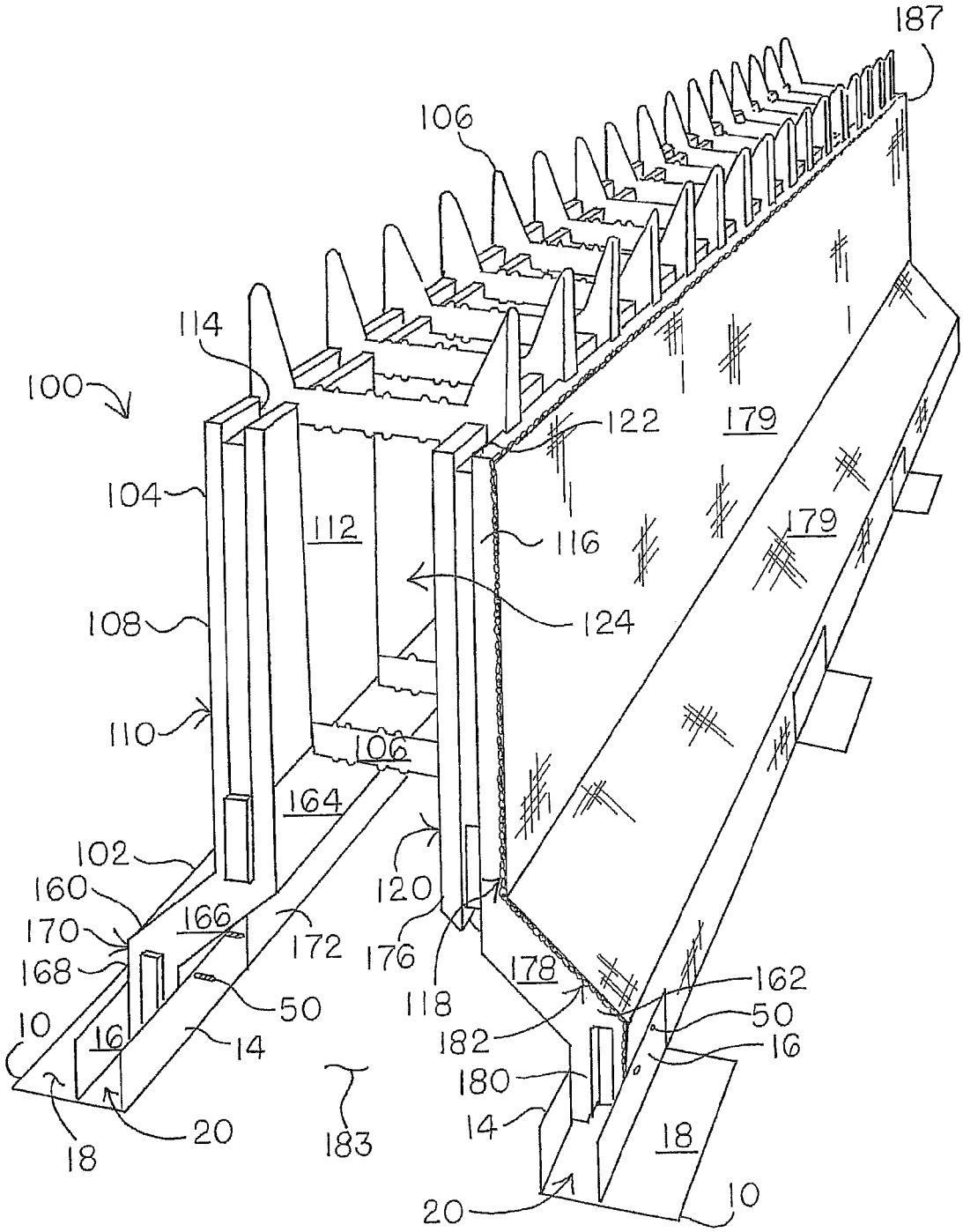
FIG. 10 shows a perspective view of an insulating concrete form using a plurality of cleats according to embodiments of the invention.

In embodiments of the invention, water impervious fabric 179 is placed over an outward facing surface of insulating concrete form assembly 100. As shown in FIG. 10, water impervious fabric 179 covers outer surfaces 118 and 182 of insulating concrete form assembly 100.

As used herein, "outward facing surface" refers to the portion of the surface of a form that will be exposed to the earth and weather outside of the perimeter of the wall. Typically, top edge 187 of water impervious fabric 179 will extend above grade when the wall is completed.

Typically, water impervious fabric 179 is a layered fabric that includes channels, capillaries, and/or dimples that provide for seepage and/or drainage of moisture. The materials of construction for water impervious fabric 179 are typically pressure resistant, rot-proof, and resistant to saline solutions, inorganic acids, alkalis, and liquids such as alcohols, organic acids, esters, ketones, and similar substances and are typically not damaged or affected by minerals, humic acid, or bacterial decomposition in the earth and is resistant to bacteria, fungi and/or microorganism attack it. In many embodiments, water impervious fabric 179 is constructed using thermoplastics, non-limiting examples of which include polyethylene and polypropylene.

According to the invention, a plurality of insulating concrete forms 100 are spaced along the perimeter of a wall such that a bottom portion (shown as lower leg 168 of first footer panel 160 and lower leg 180 of second footer panel 162) of insulating concrete form 100 components are press fit into space 20 defined by first vertical flange 14, second vertical flange 16 and base plate 18.

Fasteners 50 can be applied through first fastener holes 52 and second fastener holes 54. In embodiments of the invention as shown in FIGS. 7-10, fasteners 50 are applied such that any exposed ends terminate inside chambers 124 or 183 in order to minimize the chance of injury to installers. Fasteners 50 are used to secure insulating concrete forms 100 to cleats 10 when there is a possibility that a press fit connection is not sufficient to secure insulating concrete forms 100 to cleats 10.

Anchors 180 can be used to secure cleat 10 to the surface below as described above.

In embodiments of the invention, the insulating concrete forms comprise a rectangular foamed plastic body having one or more beam forms and/or one or more column forms defined therein. In these embodiments, a bottom portion of the insulating concrete form is press fit into the space defined by the first vertical flange, second vertical flange and the base plate. Generally, the first vertical flange contacts an outward facing surface of the rectangular foamed plastic body and the second vertical flange contacts an inner facing surface of the rectangular foamed plastic body.

Figure 12:
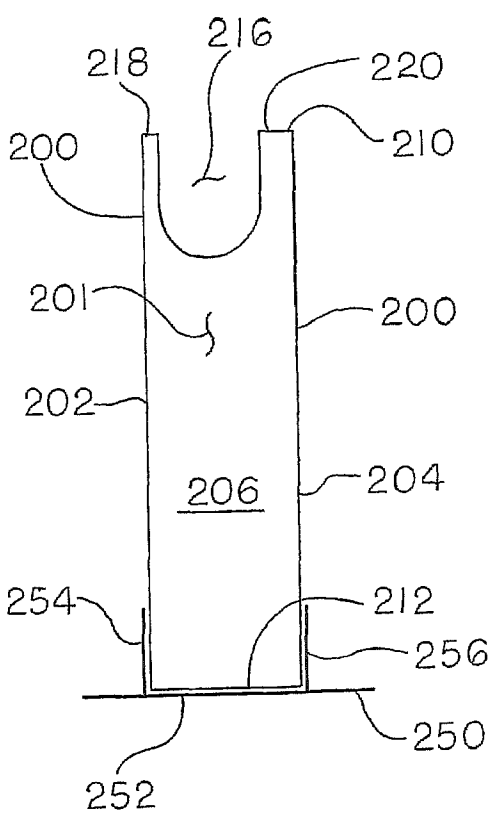
FIG. 12 shows a front elevation view of an insulating concrete form using a cleat according to embodiments of the invention.
Figure 11:
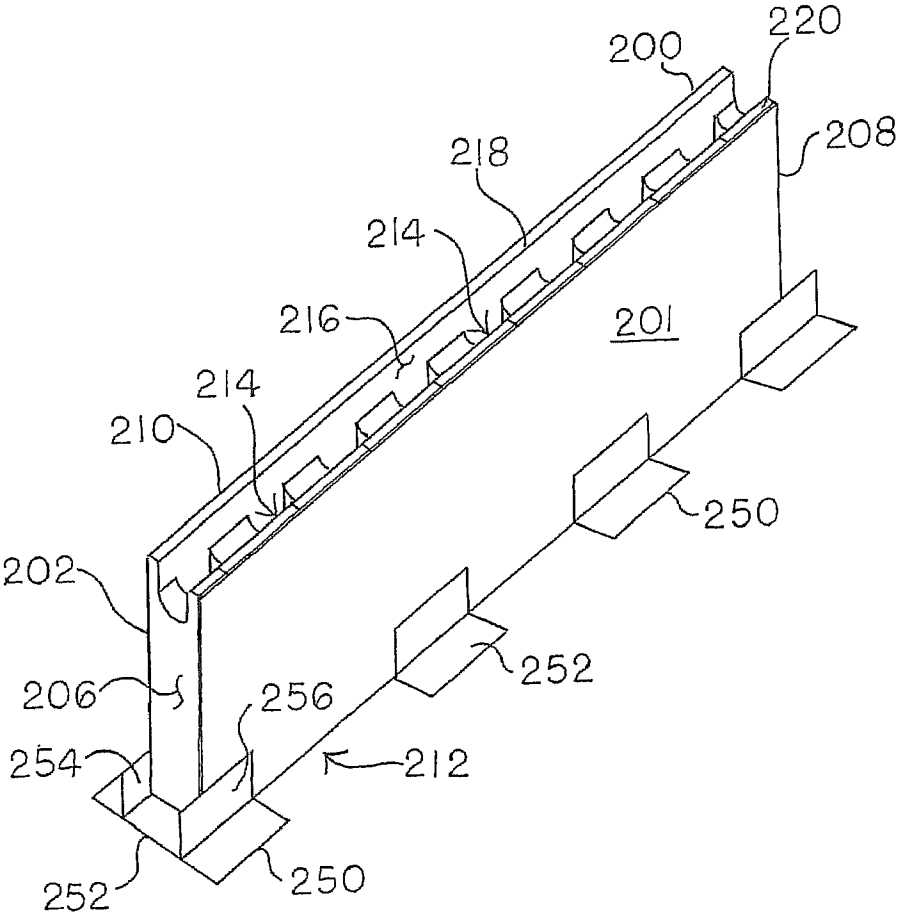
FIG. 11 shows a perspective view of an insulating concrete form using a plurality of cleats according to embodiments of the invention.

In particular embodiments of the invention as shown in FIGS. 11 and 12, unitary one-piece insulating concrete form 200 is a generally rectangular foamed plastic body 201 having first side 202, second side 204 oppositely opposed to the first side 202, first end 206, second end 208 oppositely opposed to first end 206, top surface 210, bottom surface 212 oppositely opposed to top surface 210, and at least two column forms 214.

Top surface includes first portion bond beam form 216, first top ledge 218, and second top ledge 220.

First portion bond beam form 216 extends into body 201 lengthwise and is defined by a top depression extending transversely the length of body 201 from first end 206 to second end 208.

First top ledge 218 extends lengthwise along body 201 from along top depression. Second top ledge 220 extends lengthwise along the body from along top depression.

Bottom surface 212 includes a second portion bond beam form (not shown). The second portion bond beam form extends into body 201 lengthwise and is defined by a bottom depression extending transversely the length of body 201 from first end 206 to second end 208.

Column forms 214 extend from the top depression to the bottom depression.

Cleat 250 includes base plate 252, first vertical flange 254, extending approximately perpendicular from base plate 252, and second vertical flange 256 extending approximately perpendicular from base plate 252 and approximately parallel to first vertical flange 254.

Cleat 250 can include anchor holes to secure cleat 250 to a surface under the wall perimeter as described above.

Bottom surface 212 of insulating concrete form 200 can be press fit into the space defined by first vertical flange 254, second vertical flange 256 and base plate 252. Generally, first vertical flange 254 contacts first side 202 and second vertical flange 256 contacts second side 204 of the rectangular foamed plastic body 201 to create the press fit. Fasteners can be used as described above to further secure insulating concrete form 200 to cleat 250.

The insulating concrete forms described herein ("mold units") are made of a foamed plastic that can be produced by expanding an expandable polymer matrix. The expanded polymer matrix typically includes expandable thermoplastic particles. These expandable thermoplastic particles are made from any suitable thermoplastic homopolymer or copolymer. Particularly suitable for use are homopolymers derived from vinyl aromatic monomers including styrene, isopropylstyrene, alpha-methylstyrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl methacrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g., polyethylene, polypropylene), polycarbonates, polyphenylene oxides, and mixtures thereof.

In a particular embodiment of the invention, the expandable thermoplastic particles are expandable polystyrene (EPS) particles. These particles can be in the form of beads, granules, or other particles convenient for the expansion and molding operations. Particles polymerized in an aqueous suspension process are essentially spherical and are useful for molding the mold units and/or forms described herein below. These particles can be screened so that their size ranges from about 0.008 inches (0.2 mm) to about 0.16 inches (4 mm).

In an embodiment of the invention, resin beads (unexpanded) containing any of the polymers or polymer compositions described herein have a particle size of at least 0.2 mm, in some situations at least 0.33 mm, in some cases at least 0.35 mm, in other cases at least 0.4 mm, in some instances at least 0.45 mm and in other instances at least 0.5 mm. Also, the resin beads can have a particle size of up to about 4 mm, in some situations up to about 3.5 mm, in other situations up to about 3 mm, in some instances up to 2 mm, in other instances up to 2.5 mm, in some cases up to 2.25 mm, in other cases up to 2 mm, in some situations up to 1.5 mm and in other situations up to 1 mm. The resin beads used in this embodiment can be any value or can range between any of the values recited above.

The average particle size and size distribution of the expandable resin beads or pre-expanded resin beads can be determined using low angle light scattering, which can provide a weight average value. As a non-limiting example, a Model LA-910 Laser Diffraction Particle Size Analyzer available from Horiba Ltd., Kyoto, Japan can be used As used herein, the terms "expandable thermoplastic particles" or "expandable resin beads" refers to a polymeric material in particulate or bead form that is impregnated with a blowing agent such that when the particulates and/or beads are placed in a mold or expansion device and heat is applied thereto, evaporation of the blowing agent (as described below) effects the formation of a cellular structure and/or an expanding cellular structure in the particulates and/or beads. When expanded in a mold, the outer surfaces of the particulates and/or beads fuse together to form a continuous mass of polymeric material conforming to the shape of the mold.

As used herein, the terms "pre-expanded thermoplastic particles", "pre-expanded resin beads", or "prepuff" refers to expandable resin beads that have been expanded, but not to their maximum expansion factor and whose outer surfaces have not fused. As used herein, the term "expansion factor" refers to the volume a given weight of resin bead occupies, typically expressed as cc/g. Pre-expanded resin beads can be further expanded in a mold where the outer surfaces of the pre-expanded resin beads fuse together to form a continuous mass of polymeric material conforming to the shape of the mold.

The expandable thermoplastic particles can be impregnated using any conventional method with a suitable blowing agent. As a non-limiting example, the impregnation can be achieved by adding the blowing agent to the aqueous suspension during the polymerization of the polymer, or alternatively by re-suspending the polymer particles in an aqueous medium and then incorporating the blowing agent as taught in U.S. Pat. No. 2,983,692. Any gaseous material or material which will produce gases on heating can be used as the blowing agent. Conventional blowing agents include aliphatic hydrocarbons containing 4 to 6 carbon atoms in the molecule, such as butanes, pentanes, hexanes, and the halogenated hydrocarbons, e.g., CFC's and HCFC's, which boil at a temperature below the softening point of the polymer chosen. Mixtures of these aliphatic hydrocarbon blowing agents can also be used.

Alternatively, water can be blended with these aliphatic hydrocarbons blowing agents or water can be used as the sole blowing agent as taught in U.S. Pat. Nos. 6,127,439; 6,160,027; and 6,242,540 in these patents, water-retaining agents are used. The weight percentage of water for use as the blowing agent can range from 1 to 20%. The texts of U.S. Pat. Nos. 6,127,439, 6,160,027 and 6,242,540 are incorporated herein by reference.

The impregnated thermoplastic particles are generally pre-expanded to a density of at least 0.5 $lb/ft^3$, in some cases at least 0.75 $lb/ft^3$, in other cases at least 1.0 $lb/ft^3$, in some situations at least 1.25 $lb/ft^3$, in other situations at least 1.5 $lb/ft^3$, and in some instances at least about 1.75 $lb/ft^3$. Also, the density of the impregnated pre-expanded particles can be up to 12 $lb/ft^3$, in some cases up to 10 $lb/ft^3$, and in other cases up to 5 $lb/ft^3$. The density of the impregnated pre-expanded particles can be any value or range between any of the values recited above. The pre-expansion step is conventionally carried out by heating the impregnated beads via any conventional heating medium, such as steam, hot air, hot water, or radiant heat. One generally accepted method for accomplishing the pre-expansion of impregnated thermoplastic particles is taught in U.S. Pat. No. 3,023,175.

The impregnated thermoplastic particles can be foamed cellular polymer particles as taught in U.S. Patent Application Publication No. 2002/0117769, the teachings of which are incorporated herein by reference. The foamed cellular particles can be polystyrene that are pre-expanded and contain a volatile blowing agent at a level of less than 14 wt. %, in some situations less than 8 wt. %, in some cases ranging from about 2 wt. % to about 7 wt. %, and in other cases ranging from about 2.5 wt. % to about 6.5 wt. % based on the weight of the polymer.

The thermoplastic particles according to the invention can include an interpolymer of a polyolefin and in situ polymerized vinyl aromatic monomers. Non-limiting examples of such interpolymers are disclosed in U.S. Pat. Nos. 4,303,756 and 4,303,757 and U.S. Application Publication 2004/0152795, the relevant portions of which are herein incorporated by reference. A non-limiting example of interpolymers that can be used in the present invention include those available under the trade name ARCEL®, available from NOVA Chemicals Inc., Pittsburgh, Pa. and PIOCELAN®, available from Sekisui Plastics Co., Ltd., Tokyo, Japan.

The expanded polymer matrix can include customary ingredients and additives, such as pigments, dyes, colorants, plasticizers, mold release agents, stabilizers, ultraviolet light absorbers, mold prevention agents, antioxidants, and so on. Typical pigments include, without limitation, inorganic pigments such as carbon black, graphite, expandable graphite, zinc oxide, titanium dioxide, and iron oxide, as well as organic pigments such as quinacridone reds and violets and copper phthalocyanine blues and greens.

In a particular embodiment of the invention, the pigment is carbon black, a non-limiting example of such a material being EPS SILVER®, available from NOVA Chemicals Inc.

In another particular embodiment of the invention, the pigment is graphite, a non-limiting example of such a material being NEOPOR®, available from BASF Aktiengesellschaft Corp., Ludwigshafen am Rhein, Germany.

The pre-expanded particles or "pre-puff" are usually heated in a closed mold to form the present mold units.

In the present invention, insulating concrete walls are provided by placing concrete into the insulating concrete forms described above and allowing the concrete to harden and cure to form the insulating concrete walls.

Any suitable type of concrete composition can be used to make the concrete walls and concrete foundation systems described herein. The specific type of concrete will depend on the desired and designed properties of the concrete walls and foundation systems. In embodiments of the invention, the concrete includes one or more hydraulic cement compositions selected from Portland cements, pozzolana cements, gypsum cements, aluminous cements, magnesia cements, silica cements, and slag cements.

In an embodiment of the invention, the cement includes a hydraulic cement composition. The hydraulic cement composition can be present at a level of at least 3, in certain situations at least 5, in some cases at least 7.5, and in other cases at least 9 volume percent and can be present at levels up to 40, in some cases up to 35, in other cases up to 32.5, and in some instances up to 30 volume percent of the cement mixture. The cement mixture can include the hydraulic cement composition at any of the above-stated levels or at levels ranging between any of levels stated above.

In an embodiment of the invention, the concrete mixture can optionally include other aggregates and adjuvants known in the art including but not limited to sand, additional aggregate, plasticizers and/or fibers. Suitable fibers include, but are not limited to glass fibers, silicon carbide, aramid fibers, polyester, carbon fibers, composite fibers, fiberglass, metal and combinations thereof as well as fabric containing the above-mentioned fibers, and fabric containing combinations of the above-mentioned fibers.

Non-limiting examples of fibers that can be used in the invention include MeC-GRID® and C-GRID® available from TechFab, LLC, Anderson, S.C.; KEVLAR® available from E.I. du Pont de Nemours and Company, Wilmington, Del.; TWARON® available from Teijin Twaron B. V., Arnheim, the Netherlands; SPECTRA® available from Honeywell International Inc., Morristown, N.J.; DACRON® available from Invista North America S.A.R.L. Corp. Wilmington, Del.; and VECTRAN® available from Hoechst Celanese Corp., New York, N.Y. The fibers can be used in a mesh structure, intertwined, interwoven, and oriented in any desirable direction.

In a particular embodiment of the invention, fibers can make up at least 0.1, in some cases at least 0.5, in other cases at least 1, and in some instances at least 2 volume percent of the concrete composition. Further, fibers can provide up to 10, in some cases up to 8, in other cases up to 7, and in some instances up to 5 volume percent of the concrete composition. The amount of fibers is adjusted to provide desired properties to the concrete composition. The amount of fibers can be any value or range between any of the values recited above.

Further to this embodiment, the additional aggregate can include, but is not limited to, one or more materials selected from common aggregates such as sand, stone, and gravel. Common lightweight aggregates can include ground granulated blast furnace slag, fly ash, glass, silica, expanded slate and clay; insulating aggregates such as pumice, perlite, vermiculite, scoria, and diatomite; light-weight aggregate such as expanded shale, expanded slate, expanded clay, expanded slag, fumed silica, pelletized aggregate, extruded fly ash, tuff, and macrolite; and masonry aggregate such as expanded shale, clay, slate, expanded blast furnace slag, sintered fly ash, coal cinders, pumice, scoria, and pelletized aggregate.

When included, the other aggregates and adjuvants are present in the concrete mixture at a level of at least 0.5, in some cases at least 1, in other cases at least 2.5, in some instances at least 5 and in other instances at least 10 volume percent of the concrete mixture. Also, the other aggregates and adjuvants can be present at a level of up to 95, in some cases up to 90, in other cases up to 85, in some instances up to 65 and in other instances up to 60 volume percent of the concrete mixture. The other aggregates and adjuvants can be present in the concrete mixture at any of the levels indicated above or can range between any of the levels indicated above.

In embodiments of the invention, the concrete compositions can contain one or more additives, non-limiting examples of such being anti-foam agents, water-proofing agents, dispersing agents, set-accelerators, set-retarders, plasticizing agents, superplasticizing agents, freezing point decreasing agents, adhesiveness-improving agents, and colorants. The additives are typically present at less than one percent by weight with respect to total weight of the composition, but can be present at from 0.1 to 3 weight percent.

Suitable dispersing agents or plasticizers that can be used in the invention include, but are not limited to hexametaphosphate, tripolyphosphate, polynaphthalene sulphonate, sulphonated polyamine and combinations thereof.

Suitable plasticizing agents that can be used in the invention include, but are not limited to polyhydroxycarboxylic acids or salts thereof, polycarboxylates or salts thereof, lignosulfonates, polyethylene glycols, and combinations thereof.

Suitable superplasticizing agents that can be used in the invention include, but are not limited to alkaline or earth alkaline metal salts of lignin sulfonates; lignosulfonates, alkaline or earth alkaline metal salts of highly condensed naphthalene sulfonic acid/formaldehyde condensates; polynaphthalene sulfonates, alkaline or earth alkaline metal salts of one or more polycarboxylates (such as poly(meth) acrylates and the polycarboxylate comb copolymers described in U.S. Pat. No. 6,800,129, the relevant portions of which are herein incorporated by reference); alkaline or earth alkaline metal salts of melamine/formaldehyde/sulfite condensates; sulfonic acid esters; carbohydrate esters; and combinations thereof.

Suitable set-accelerators that can be used in the invention include, but are not limited to soluble chloride salts (such as calcium chloride), triethanolamine, paraformaldehyde, soluble formate salts (such as calcium formate), sodium hydroxide, potassium hydroxide, sodium carbonate, sodium sulfate, $12CaO.7Al_2O_3$, sodium sulfate, aluminum sulfate, iron sulfate, the alkali metal nitrate/sulfonated aromatic hydrocarbon aliphatic aldehyde condensates disclosed in U.S. Pat. No. 4,026,723, the water soluble surfactant accelerators disclosed in U.S. Pat. No. 4,298,394, the methylol derivatives of amino acids accelerators disclosed in U.S. Pat. No. 5,211,751, and the mixtures of thiocyanic acid salts, alkanolamines, and nitric acid salts disclosed in U.S. Pat. No. Re. 35,194, the relevant portions of which are herein incorporated by reference, and combinations thereof.

Suitable set-retarders that can be used in the invention include, but are not limited to lignosulfonates, hydroxycarboxylic acids (such as gluconic acid, citric acid, tartaric acid, maleic acid, salicylic acid, glucoheptonic acid, arabonic acid, and inorganic or organic salts thereof such as sodium, potassium, calcium, magnesium, ammonium and triethanolamine salt), cardonic acid, sugars, modified sugars, phosphates, borates, silico-fluorides, calcium bromate, calcium sulfate, sodium sulfate, monosaccharides such as glucose, fructose, galactose, saccharose, xylose, apiose, ribose and invert sugar, oligosaccharides such as disaccharides and trisaccharides, oligosaccharides such as dextrin, polysaccharides such as dextran, and other saccharides such as molasses containing these; sugar alcohols such as sorbitol; magnesium silicofluoride; phosphoric acid and salts thereof, or borate esters; aminocarboxylic acids and salts thereof; alkali-soluble proteins; humic acid; tannic acid; phenols; polyhydric alcohols such as glycerol; phosphonic acids and derivatives thereof, such as aminotri(methylenephosphonic acid), 1-hydroxyethylidene-1,1-diphosphonic acid, ethylenediaminetetra(methylenephosphonic acid), diethylenetriaminepenta(methylenephosphonic acid), and alkali metal or alkaline earth metal salts thereof, and combinations of the set-retarders indicated above.

Suitable defoaming agents that can be used in the invention include, but are not limited to silicone-based defoaming agents (such as dimethylpolysiloxane, dimethylsilicone oil, silicone paste, silicone emulsions, organic group-modified polysiloxanes (polyorganosiloxanes such as dimethylpolysiloxane), fluorosilicone oils, etc.), alkyl phosphates (such as tributyl phosphate, sodium octylphosphate, etc.), mineral oil-based defoaming agents (such as kerosene, liquid paraffin, etc.), fat- or oil-based defoaming agents (such as animal or vegetable oils, sesame oil, castor oil, alkylene oxide adducts derived there from, etc.), fatty acid-based defoaming agents (such as oleic acid, stearic acid, and alkylene oxide adducts derived there from, etc.), fatty acid ester-based defoaming agents (such as glycerol monoricinolate, alkenylsuccinic acid derivatives, sorbitol monolaurate, sorbitol trioleate, natural waxes, etc.), oxyalkylene type defoaming agents, alcohol-based defoaming agents: octyl alcohol, hexadecyl alcohol, acetylene alcohols, glycols, etc.), amide-based defoaming agents (such as acrylate polyamines, etc.), metal salt-based defoaming agents (such as aluminum stearate, calcium oleate, etc.) and combinations of the above-described defoaming agents.

Suitable freezing point decreasing agents that can be used in the invention include, but are not limited to ethyl alcohol, calcium chloride, potassium chloride, and combinations thereof.

Suitable adhesiveness-improving agents that can be used in the invention include, but are not limited to polyvinyl acetate, styrene-butadiene, homopolymers and copolymers of (meth) acrylate esters, and combinations thereof.

Suitable water-repellent or water-proofing agents that can be used in the invention include, but are not limited to fatty acids (such as stearic acid or oleic acid), lower alkyl fatty acid esters (such as butyl stearate), fatty acid salts (such as calcium or aluminum stearate), silicones, wax emulsions, hydrocarbon resins, bitumen, fats and oils, silicones, paraffins, asphalt, waxes, and combinations thereof. Although not used in many embodiments of the invention, when used suitable air-entraining agents include, but are not limited to vinsol resins, sodium abietate, fatty acids and salts thereof, tensides, alkyl-aryl-sulfonates, phenol ethoxylates, lignosulfonates, and mixtures thereof.

In some embodiments of the invention, the concrete is light-weight concrete. As used herein, the term "light weight concrete" refers to concrete where light-weight aggregate is included in a cementitious mixture. Exemplary light weight concrete compositions that can be used in the present invention are disclosed in U.S. Pat. Nos. 3,021,291, 3,214,393, 3,257,338, 3,272,765, 5,622,556, 5,725,652, 5,580,378, and 6,851,235, U.S. Patent Application Publication No. 2007/0125275 as well as JP 9 071 449, WO 98 02 397, WO 00/61519, and WO 01/66485 the relevant portions of which are incorporated herein by reference.

In particular embodiments of the present invention, the lightweight concrete (LWC) composition includes a concrete mixture and polymer particles. In many instances, the size, composition, structure, and physical properties of expanded polymer particles, and, in some instances, their resin bead precursors, can greatly affect the physical properties of LWC used in the invention. Of particular note is the relationship between bead size and expanded polymer particle density on the physical properties of the resulting LWC wall.

The polymer particles, which can optionally be expanded polymer particles, are present in the LWC composition at a level of at least 10, in some instances at least 15, in other instances at least 20, in particular situations up to 25, in some cases at least 30, and in other cases at least 35 volume percent and up to 90, in some cases up to 85, in other cases up to 78, in some instances up to 75, in other instance up to 65, in particular instances up to 60, in some cases up to 50, and in other cases up to 40 volume percent based on the total volume of the LWC composition. The amount of polymer particles will vary depending on the particular physical properties desired in a finished LWC wall. The amount of polymer particles in the LWC composition can be any value or can range between any of the values recited above.

The polymer particles can include any particles derived from any suitable expandable thermoplastic material. The actual polymer particles are selected based on the particular physical properties desired in a finished LWC wall. As a non-limiting example, the polymer particles, which can optionally be expanded polymer particles, can include one or more polymers selected from homopolymers of vinyl aromatic monomers; copolymers of at least one vinyl aromatic monomer with one or more of divinylbenzene, conjugated dienes, alkyl methacrylates, alkyl acrylates, acrylonitrile, and/or maleic anhydride; polyolefins; polycarbonates; polyesters; polyamides; natural rubbers; synthetic rubbers; and combinations thereof.

In an embodiment of the invention, the polymer particles include thermoplastic homopolymers or copolymers selected from homopolymers derived from vinyl aromatic monomers including styrene, isopropylstyrene, alpha-methylstyrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl methacrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g., polyethylene, polypropylene), polycarbonates, polyphenylene oxides, and mixtures thereof.

In a particular embodiment of the invention, the polymer particles are expandable polystyrene (EPS) particles. These particles can be in the form of beads, granules, or other particles.

Methods of making the unexpanded and expanded polymer particles are described above.

In an embodiment of the invention, resin beads (unexpanded) containing any of the polymers or polymer compositions described herein have a particle size of at least 0.2 mm, in some situations at least 0.33 mm, in some cases at least 0.35 mm, in other cases at least 0.4 mm, in some instances at least 0.45 mm and in other instances at least 0.5 mm. Also, the resin beads can have a particle size of up to 3 mm, in some instances up to 2 mm, in other instances up to 2.5 mm, in some cases up to 2.25 mm, in other cases up to 2 mm, in some situations up to 1.5 mm and in other situations up to 1 mm. In this embodiment, the physical properties of LWC walls made according to the invention have inconsistent or undesirable physical properties when resin beads having particle sizes outside of the above described ranges are used to make the expanded polymer particles. The resin beads used in this embodiment can be any value or can range between any of the values recited above.

The impregnated polymer particles or resin beads are optionally expanded to a bulk density of at least 1.75 lb/ft$^3$ (0.028 g/cc), in some circumstances at least 2 lb/ft$^3$ (0.032 g/cc) in other circumstances at least 3 lb/ft$^3$ (0.048 g/cc) and in particular circumstances at least 3.25 lb/ft$^3$ (0.052 g/cc) or 3.5 lb/ft$^3$ (0.056 g/cc). When non-expanded resin beads are used, higher bulk density beads can be used. As such, the bulk density can be as high as 40 lb/ft$^3$ (0.64 g/cc). In other situations, the polymer particles are at least partially expanded and the bulk density can be up to 35 lb/ft$^3$ (0.56 g/cc), in some cases up to 30 lb/ft$^3$ (0.48 g/cc), in other cases up to 25 lb/ft$^3$ (0.4 g/cc), in some instances up to 20 lb/ft$^3$ (0.32 g/cc), in other instances up to 15 lb/ft$^3$ (0.24 g/cc) and in certain circumstances up to 10 lb/ft$^3$ (0.16 g/cc). The bulk density of the polymer particles can be any value or range between any of the values recited above. The bulk density of the polymer particles, resin beads and/or prepuff particles is determined by weighing a known volume of polymer particles, beads and/or prepuff particles (aged 24 hours at ambient conditions).

The impregnated polymer particles can be foamed cellular polymer particles as taught in U.S. Patent Application Publication No. 2002/0117769, the teachings of which are incorporated herein by reference. The foamed cellular particles can be polystyrene that are expanded and contain a volatile blowing agent at a level of less than 14 wt. %, in some situations less than 8 wt. %, in some cases ranging from about 2 wt. % to about 7 wt. %, and in other cases ranging from about 2.5 wt. % to about 6.5 wt. % based on the weight of the polymer.

An interpolymer of a polyolefin and in situ polymerized vinyl aromatic monomers that can be included in the expanded thermoplastic resin or polymer particles according to the invention is disclosed in U.S. Pat. Nos. 4,303,756 and 4,303,757 and U.S. Application Publication 2004/0152795, the relevant portions of which are herein incorporated by reference.

The polymer particles can include customary ingredients and additives, such as flame retardants, pigments, dyes, colorants, plasticizers, mold release agents, stabilizers, ultraviolet light absorbers, mold prevention agents, antioxidants, rodenticides, insect repellants, and so on. Typical pigments include, without limitation, inorganic pigments such as carbon black, graphite, expandable graphite, zinc oxide, titanium dioxide, and iron oxide, as well as organic pigments such as quinacridone reds and violets and copper phthalocyanine blues and greens.

In a particular embodiment of the invention, the pigment is carbon black, a non-limiting example of such a material being EPS SILVER®, available from NOVA Chemicals Inc.

In another particular embodiment of the invention, the pigment is graphite, a non-limiting example of such a material being NEOPOR®, available from BASF Aktiengesellschaft Corp., Ludwigshafen am Rhein, Germany.

When materials such as carbon black and/or graphite are included in the polymer particles, improved insulating properties, as exemplified by higher R values for materials containing carbon black or graphite (as determined using ASTM-C518), are provided. As such, the R value of the expanded polymer particles containing carbon black and/or graphite or materials made from such polymer particles are at least 5% higher than observed for particles or resulting walls that do not contain carbon black and/or graphite.

The expanded polymers can have an average particle size of at least 0.2, in some circumstances at least 0.3, in other circumstances at least 0.5, in some cases at least 0.75, in other cases at least 0.9 and in some instances at least 1 mm and can be up to 8, in some circumstances up to 6, in other circumstances up to 5, in some cases up to 4, in other cases up to 3, and in some instances up to 2.5 mm. When the size of the expanded polymer particles is too small or too large, the physical properties of LWC walls made using the present LWC composition can be undesirable. The average particle size of the expanded polymer particles can be any value and can range between any of the values recited above. The average particle size of the expanded polymer particles can be determined using laser diffraction techniques or by screening according to mesh size using mechanical separation methods well known in the art.

In an embodiment of the invention, the polymer particles or expanded polymer particles have a minimum average cell wall thickness, which helps to provide desirable physical properties to LWC walls made using the present LWC composition. The average cell wall thickness and inner cellular dimensions can be determined using scanning electron microscopy techniques known in the art. The expanded polymer particles can have an average cell wall thickness of at least 0.15 μm, in some cases at least 0.2 μm and in other cases at least 0.25 μm. Not wishing to be bound to any particular theory, it is believed that a desirable average cell wall thickness results when resin beads having the above-described dimensions are expanded to the above-described densities.

In an embodiment of the invention, the polymer beads are optionally expanded to form the expanded polymer particles such that a desirable cell wall thickness as described above is achieved. Though many variables can impact the wall thickness, it is desirable, in this embodiment, to limit the expansion of the polymer bead so as to achieve a desired wall thickness and resulting expanded polymer particle strength. Optimizing processing steps and blowing agents can expand the polymer beads to a minimum of 1.75 $lb/ft^3$ (0.028 g/cc). This property of the expanded polymer bulk density, can be described by pcf ($lb/ft^3$) or by an expansion factor (cc/g).

As used herein, the term "expansion factor" refers to the volume a given weight of expanded polymer bead occupies, typically expressed as cc/g.

In order to provide expanded polymer particles with desirable cell wall thickness and strength, the expanded polymer particles are not expanded to their maximum expansion factor; as such, an extreme expansion yields particles with undesirably thin cell walls and insufficient strength. Further, the polymer beads can be expanded at least 5%, in some cases at least 10%, and in other cases at least 15% of their maximum expansion factor. However, so as not to cause the cell wall thickness to be too thin, the polymer beads are expanded up to 80%, in some cases up to 75%, in other cases up to 70%, in some instances up to 65%, in other instances up to 60%, in some circumstances up to 55%, and in other circumstances up to 50% of their maximum expansion factor. The polymer beads can be expanded to any degree indicated above or the expansion can range between any of the values recited above. Typically, the polymer beads or prepuff beads do not further expand when formulated into the present concrete compositions and do not further expand while the concrete compositions set, cure and/or harden.

The prepuff or expanded polymer particles typically have a cellular structure or honeycomb interior portion and a generally smooth continuous polymeric surface as an outer surface, i.e., a substantially continuous outer layer. The smooth continuous surface can be observed using scanning electron microscope (SEM) techniques at 1000× magnification. SEM observations do not indicate the presence of holes in the outer surface of the prepuff or expanded polymer particles. Cutting sections of the prepuff or expanded polymer particles and taking SEM observations reveals the generally honeycomb structure of the interior of the prepuff or expanded polymer particles.

The polymer particles or expanded polymer particles can have any cross-sectional shape that allows for providing desirable physical properties in LWC walls. In an embodiment of the invention, the expanded polymer particles have a circular, oval or elliptical cross-section shape. In embodiments of the invention, the prepuff or expanded polymer particles have an aspect ratio of 1, in some cases at least 1 and the aspect ratio can be up to 3, in some cases up to 2 and in other cases up to 1.5. The aspect ratio of the prepuff or expanded polymer particles can be any value or range between any of the values recited above.

In particular embodiments of the invention, the light-weight concrete includes from 10 to 90 volume percent of a cement composition, from 10 to 90 volume percent of particles having an average particle diameter of from 0.2 mm to 8 mm, a bulk density of from 0.028 g/cc to 0.64 g/cc, an aspect ratio of from 1 to 3, and from 10 to 50 volume percent of sand and/or other fine aggregate, where the sum of components used does not exceed 100 volume percent.

Light-weight concrete compositions that are particularly useful in the present invention include those disclosed in co-pending U.S. Publication Application No. 2006/0225618, the relevant portions of the disclosure are incorporated herein by reference.

As those skilled in the art can appreciate, the insulating concrete walls according to the invention can be used as foundations and/or wall systems for a building or other structure.

The present invention has been described with reference to specific details of particular embodiments thereof. It is not intended that such details be regarded as limitations upon the scope of the invention except insofar as and to the extent that they are included in the accompanying claims.

What is claimed is:

1. A method of constructing an insulating concrete wall comprising:

placing a plurality of cleats along a wall perimeter, wherein the cleats consist of a base plate, a first vertical flange extending approximately perpendicular from the base plate, and a second vertical flange extending approximately perpendicular from the base plate and approximately parallel to the first vertical flange, wherein the space defined by the first vertical flange, second vertical flange and the base plate, is adapted to receive a bottom portion of a form component or a bottom portion of a form;

securing the cleats to a surface under the wall perimeter;

placing a plurality of insulating concrete forms along the perimeter such that a bottom portion of the form components or a bottom portion of the form are press fit into the space defined by the first vertical flange, second vertical flange and the base plate; and placing concrete into the insulating concrete forms to form the insulating concrete wall.

2. The method according to claim 1, wherein the cleats comprise a material selected from the group consisting of metal, construction grade plastics, composite materials, ceramics, and combinations thereof.

3. The method according to claim 2, wherein the metal is selected from the group consisting of aluminum, steel, stainless steel, tungsten, molybdenum, iron and alloys and combinations of such metals.

4. The method according to claim 2, wherein the construction grade plastics are selected from the group consisting of reinforced thermoplastics, thermoset resins, reinforced thermoset resins and combinations thereof.

5. The method according to claim 1, wherein the insulating concrete forms comprise a rectangular foamed plastic body having one or more beam forms and one or more column forms defined therein.

6. The method according to claim 5, wherein the first vertical flange contacts an outward facing surface of the rectangular foamed plastic body and the second vertical flange contacts an inner facing surface of the rectangular foamed plastic body.

7. The method according to claim 1, wherein the insulating concrete form comprises (A) a first panel member comprising:

(1) a first outer panel side including a first wall surface area extending generally vertically thereon;

(2) a first inner panel side positioned oppositely from said first outer panel side; and (3) at least two first slots in the first inner panel side adapted to accept a connecting member;

(B) a second panel member comprising:

(1) a second outer panel side including a second wall surface area extending generally vertically thereon and facing oppositely from said first panel member;

(2) a second inner panel side positioned oppositely from said second outer panel side and facing said first inner panel side of said first panel member; and (3) at least two second slots in the second inner panel side adapted to accept a connecting member; and (C) at least two connecting members detachable and securable with respect to said first panel member and said second panel member adapted to maintain a spatial distance therebetween for defining a molding chamber therebetween, the connecting members comprising:

(1) a first flange detachably and securably extending within said first slot of said first panel member;

(2) a second flange detachably and securably extending within said second slot of said second panel member; and (3) a mid-section portion.

8. The method according to claim 7, wherein:

(A) the first panel member is press fit into one or more first cleats such that the first vertical flange contacts the first outer panel side and the second vertical flange contacts the first inner panel side; and (B) the second panel member is press fit into one or more second cleats such that the first vertical flange contacts the second outer panel side and the second vertical flange contacts the second inner panel side.

9. The method according to claim 7, wherein the first panel member and the second panel member each have a male end comprising a tongue edge and a female end comprising a female groove edge that facilitates a tongue and groove union between corresponding members.

10. The method according to claim 7, wherein the connecting member comprises a material selected from the group consisting of plastics, metal, construction grade plastics, composite materials, ceramics, and the like.

11. The method according to claim 1, wherein the insulating concrete forms comprise an expanded polymer matrix.

12. The method according to claim 11, wherein the expanded polymer matrix comprises one or more polymers selected from the group consisting of homopolymers of vinyl aromatic monomers; copolymers of at least one vinyl aromatic monomer with one or more of divinylbenzene, conjugated dienes, alkyl methacrylates, alkyl acrylates, acrylonitrile, and/or maleic anhydride; polyolefins; polycarbonates; an interpolymer of a polyolefin and in situ polymerized vinyl aromatic monomers; and combinations thereof.

13. The method according to claim 11, wherein the polymer matrix comprises carbon black, graphite or a combination thereof.

14. The method according to claim 1, wherein the concrete comprises one or more cements selected from the group consisting of Portland cements, pozzolana cements, gypsum cements, aluminous cements, magnesia cements, silica cements, and slag cements.

15. The method according to claim 1, wherein the concrete is light weight concrete.

16. The method according to claim 1, wherein the concrete comprises 8-20 volume percent cement, 11-50 volume percent sand, 10-31 volume percent expanded thermoplastic particles, 9-40 volume percent coarse aggregate, and 10-22 volume percent water;

wherein the expanded thermoplastic particles have an average particle diameter of from 0.2 mm to 8 mm, a bulk density of from 0.02 g/cc to 0.64 g/cc, an aspect ratio of from 1 to 3.

17. The method according to claim 1, wherein rebar is placed in one or more molding chambers of the insulating concrete forms prior to placing the concrete.

18. The method according to claim 1, wherein a water impervious fabric is placed over at least a portion of an outward facing surface of the insulating concrete forms.

19. An insulating concrete wall constructed according to the method of claim 1.

20. A building comprising the insulating concrete wall according to claim 19.

* * * * *